US009482431B2

(12) United States Patent
Kelly

(10) Patent No.: US 9,482,431 B2
(45) Date of Patent: Nov. 1, 2016

(54) RADIALLY FIRING IGNITER

(75) Inventor: Ewen M. Kelly, Norwich, NY (US)

(73) Assignee: Chentronics, LLC, Norwich, NY (US)

( * ) Notice: Subject to any disclaimer, the term of this patent is extended or adjusted under 35 U.S.C. 154(b) by 1109 days.

(21) Appl. No.: 13/564,283

(22) Filed: Aug. 1, 2012

(65) Prior Publication Data

US 2014/0038114 A1 Feb. 6, 2014

(51) Int. Cl.

| | |
|---|---|
| ***F23Q 1/00*** | (2006.01) |
| ***F23Q 3/00*** | (2006.01) |
| ***F23Q 9/00*** | (2006.01) |
| ***H01T 13/52*** | (2006.01) |
| ***H01T 13/46*** | (2006.01) |

(52) U.S. Cl.

CPC . *F23Q 3/00* (2013.01); *F23Q 9/00* (2013.01); *H01T 13/467* (2013.01); *H01T 13/52* (2013.01)

(58) Field of Classification Search

CPC ..... F23Q 1/00
USPC ..... 431/6, 258
See application file for complete search history.

(56) References Cited

U.S. PATENT DOCUMENTS

| | | | | |
|---|---|---|---|---|
| 2,064,089 | A | 12/1936 | Stemmeler | |
| 2,214,958 | A | 9/1940 | Gotterba et al. | |
| 2,332,210 | A | 10/1943 | Frank | |
| 2,501,826 | A | 3/1950 | McCarthy et al. | |
| 2,906,922 | A | 9/1959 | Huber | |
| 3,073,121 | A | 1/1963 | Baker et al. | |
| 3,312,848 | A | 4/1967 | Baum | |
| 4,187,825 | A | 2/1980 | Loyd, Jr. | |
| 4,621,599 | A | 11/1986 | Igashira et al. | |
| 4,695,758 | A | 9/1987 | Nishida et al. | |
| 4,711,629 | A * | 12/1987 | MacDonald | F23Q 3/008 313/30 |
| 5,074,262 | A * | 12/1991 | McAbee | H01T 13/462 123/169 MG |
| 6,048,196 | A | 4/2000 | Collier et al. | |
| 2011/0215703 | A1* | 9/2011 | Maul | H01T 13/20 313/141 |

FOREIGN PATENT DOCUMENTS

| | | |
|---|---|---|
| GB | 545351 | 5/1942 |
| GB | 819256 | 9/1959 |
| GB | 848070 | 9/1960 |
| GB | 855440 | 11/1960 |
| GB | 2361264 A | 10/2001 |
| JP | S4719237 A | 7/1972 |
| JP | S6158187 A | 3/1986 |
| JP | S5888519 U | 6/1986 |
| WO | 9927303 | 6/1999 |

OTHER PUBLICATIONS

European search report issued Mar. 3, 2016 in corresponding European application No. 13826537.6, Chentronics Corporation.
International Search Report and Written Opinion issued in correspohding PCT application No. PCT/US13/52938, Chentronics Corporation (Jan. 13, 2014).
JP2015-52554 Japanese Search Report dated Mar. 1, 2016.

* cited by examiner

*Primary Examiner* — Avinash Savani

(57) ABSTRACT

The invention pertains to ignition systems and more particularly to spark igniters for burners and burner pilots. A spark igniter is provide, which is configured so that the spark gap is on the outer side surface of the spark igniter.

12 Claims, 6 Drawing Sheets

RADIALLY FIRING IGNITER

BACKGROUND OF THE INVENTION

1. Field of the Invention

This invention pertains to ignition systems and more particularly to spark igniters for burners and burner pilots.

2. Description of the Related Art

A gas burner pilot is a device used to create a stable pilot flame by combustion of a low flow rate (relative to the main burner) gaseous fuel-air mixture. The pilot flame is used to light a larger main burner, or a difficult to light fuel. Gas pilot designs normally include an ignition system. One common type of ignition systems used in gas burner pilots, as well as other systems such as flare systems, is a high-energy ignition (HEI).

An HEI system typically utilizes a capacitive discharge exciter to pass large current pulses to a spark rod. The large current pulses are often greater than 1 kA. The spark igniter (also known as spark plug, spark rod or igniter probe) for an HEI system is generally constructed using a center electrode surrounded by an insulator and an outer conducting shell over the insulator such that, at the axially-facing ignition end of the spark rod, an air gap is formed between the center electrode and the outer conduction shell, i.e., a gap between the center electrode and the outer electrode shell or conducting shell. At this air gap, also called a spark gap, a high-energy spark can pass between the center electrode and outer conducting shell. Often a semiconductor material is applied to the insulating material at this gap to facilitate sparking. HEI systems have the ability to maintain powerful high energy sparks in adverse conditions such as cold temperatures, heavy fuels (heavy gases or oils), contamination of the igniter plug with coking or other debris and moisture presence due to steam purging or rain.

Past HEI spark igniter designs produced sparks on an axial-facing surface (referred to herein after as "axial-directed spark igniter"). One variable that affects spark energy is the size of the air gap on the axial-facing surface of the igniter. As the air gap increases, the amount of energy released during the spark event also increases. Air gaps generally range in size from 1 mm to 2 mm.

The center electrode, the electrode shell and semiconductor material erode away as sparking occurs over the course of an igniter's life. An igniter generally reaches the end of its life when either the semiconductor has worn away or when the air gap has become too large due to electrode erosion. Thus, while there is a desire to have relatively large air gaps because fuel ignition is more likely with higher energy release, problems are encountered with increasing the air gap size. Increased air gap size means either a shorter igniter life due to less material used in the center electrode and/or electrode shell or a larger higher-cost igniter due to an increased outer shell diameter and, hence, increased material. It would be desirable to have an igniter allowing for an increased gap size without significantly increasing the size or amount of material used and without adversely affecting igniter life.

In addition to the above considerations, the igniter life can be shortened by the exposure of the semiconductor material to flame radiation. In some burner pilot configurations, the flame may root in a position in which the igniter's semiconductor material is exposed to flame radiation. Flame radiation damages the semiconductor material, which generally reduces the life of an igniter. Accordingly, it would be desirable to avoid this problem in a burner pilot design.

SUMMARY OF THE INVENTION

In accordance with one embodiment of the current invention there is provided a spark igniter comprising a plurality of electrodes and an insulator, which are configured to form an elongated body having a first end, a second end and an outer surface extending between the first end and the second end. The spark igniter is configured so as to produce a radially-directed spark.

In accordance with another embodiment of the current invention there is provided a burner pilot comprising a source of electrical energy, a spark igniter, and a housing. The spark igniter has a first end, a second end, an outer surface, a center electrode, an electrode shell and an insulator. The outer surface comprises an end surface at the first end and a side surface extending from the second end toward the first end. The center electrode extends from the second end toward the first end. The electrode shell surrounds the center electrode and forms at least part of the side surface. The insulator is between the center electrode and outer electrode shell. The center electrode, the electrode shell and the insulator are configured to form a spark gap on the side surface, which produces a radially-directed spark, and the center electrode and electrode shell are connected to the source of electrical energy at the second end. The housing has a fuel flow passage which contains the first end of the spark igniter such that the spark gap is within the fuel flow passage.

In accordance with yet another embodiment of the invention, there is provided a method of igniting a fuel gas comprising: introducing the fuel gas into a flow passage having an ignition end wherein the flow passage defines an aperture at the ignition end and wherein the flow passage contains a spark igniter having an elongated igniter body terminating at a first end in a spark tip having a side surface and an end surface and wherein the spark tip is located adjacent to the ignition end of the flow passage; and producing a radially-directed spark to thus ignite the fuel and produce a flame at the ignition end.

DESCRIPTION OF THE PREFERRED EMBODIMENTS

The description below and the figures illustrate a spark igniter and burner pilot of the type used in a furnace having a main burner that supplies a fuel and air mixture to the furnace and a burner pilot adjacent to the main burner for igniting the fuel and air mixture. While the invention is described in the context of a burner pilot for such a furnace, it will be appreciated that the inventive spark igniter is more broadly applicable as an ignition system for fuels and can be applied to other systems such as flare systems.

Figure 1:
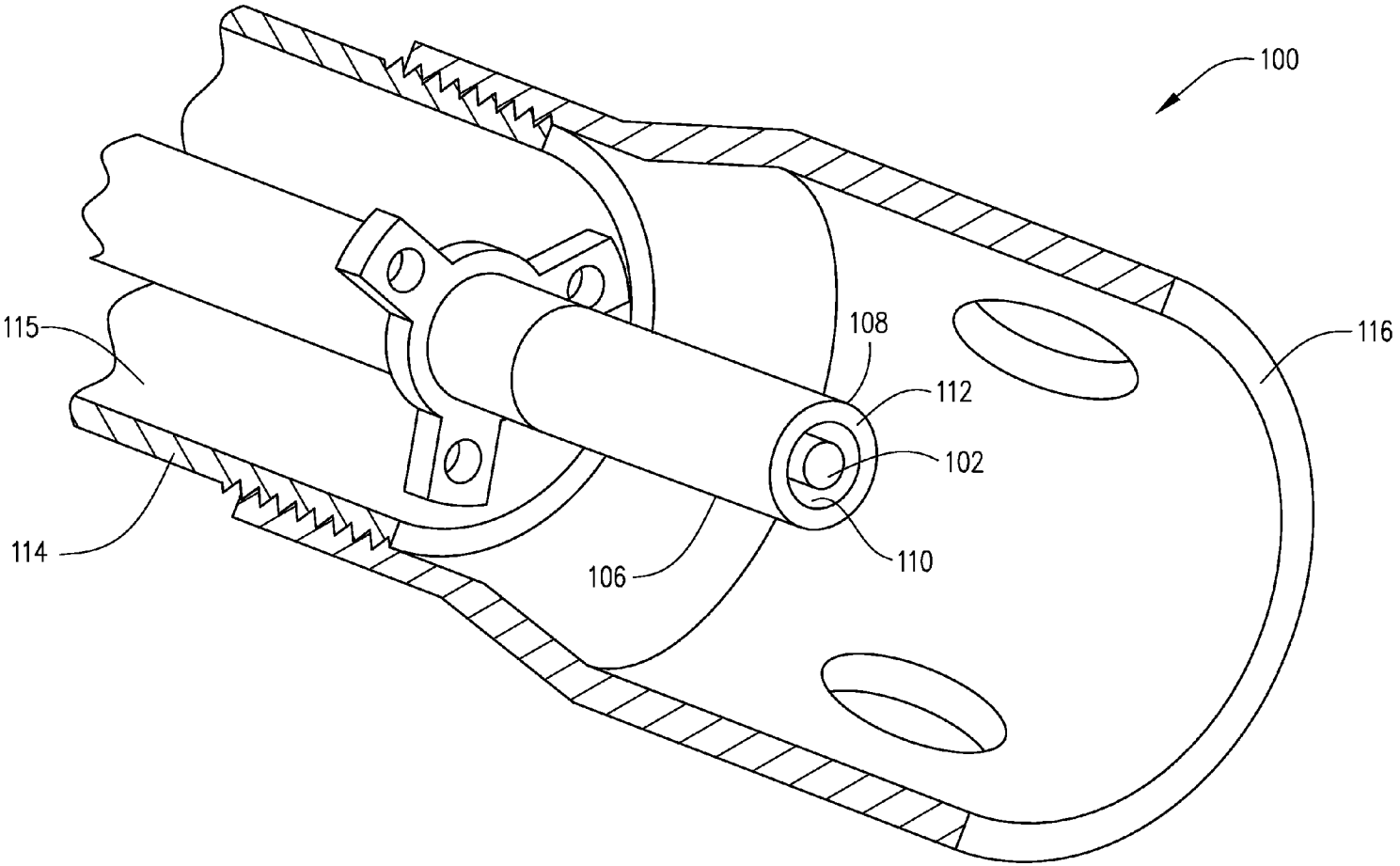
FIG. 1 PRIOR ART
FIG. 1 is a perspective view with partial cutaway of a prior art spark igniter.

Referring now to FIG. 1 a prior art axially-directed spark igniter 100 is illustrated. Spark igniter 100 has a center electrode 102 surrounded by an insulator (not shown) and an outer conducting shell or electrode shell 106 over the insulator such that, at the ignition end 108 of the spark igniter, an air gap 110 is formed between the center electrode 102 and the outer electrode shell 106, i.e., a gap between the center electrode and the outer electrode shell. Often a semiconductor material is applied to the insulating material at this gap to facilitate sparking. At this air gap 110, also called a spark gap, a high-energy spark can pass between the center electrode 102 and outer conducting shell 106.

Housing 114 surrounds spark igniter 100. Housing 114 forms a fuel channel 115, which surrounds spark igniter 100. The end 116 of housing 114 forms an opening. Fuel flows through fuel channel 115 and towards the opening in a generally axial direction parallel with the longitudinal axis of spark igniter 100.

As can be seen from FIG. 1, air gap 110 is located on the end surface or axial-facing surface 112 of the ignition end 108. Accordingly, spark igniter 100 produces an axially-directed spark, i.e., a spark directed along the longitudinal axis of the spark igniter at and away from the end surface 112. Fuel is ignited by the spark downstream from axial-facing surface 112, producing a flame adjacent to axial-facing surface 112. This location of the flame and spark gap 110 means that the spark gap and any semiconducting material are exposed to flame radiation and damage therefrom.

Figure 2:
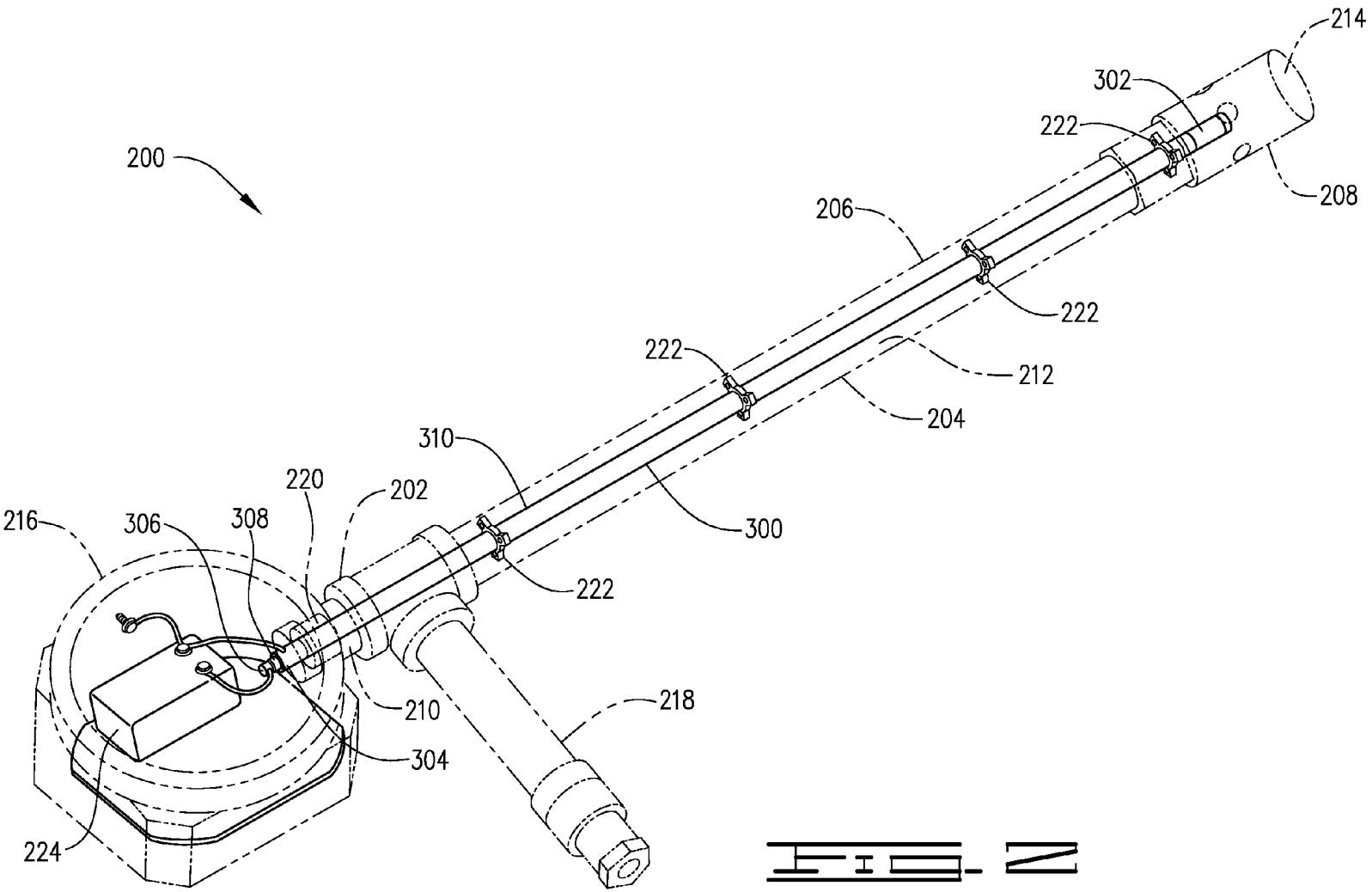
FIG. 2 is a perspective view with phantom walls of a burner pilot in accordance with an embodiment of the current invention.
Figure 3:
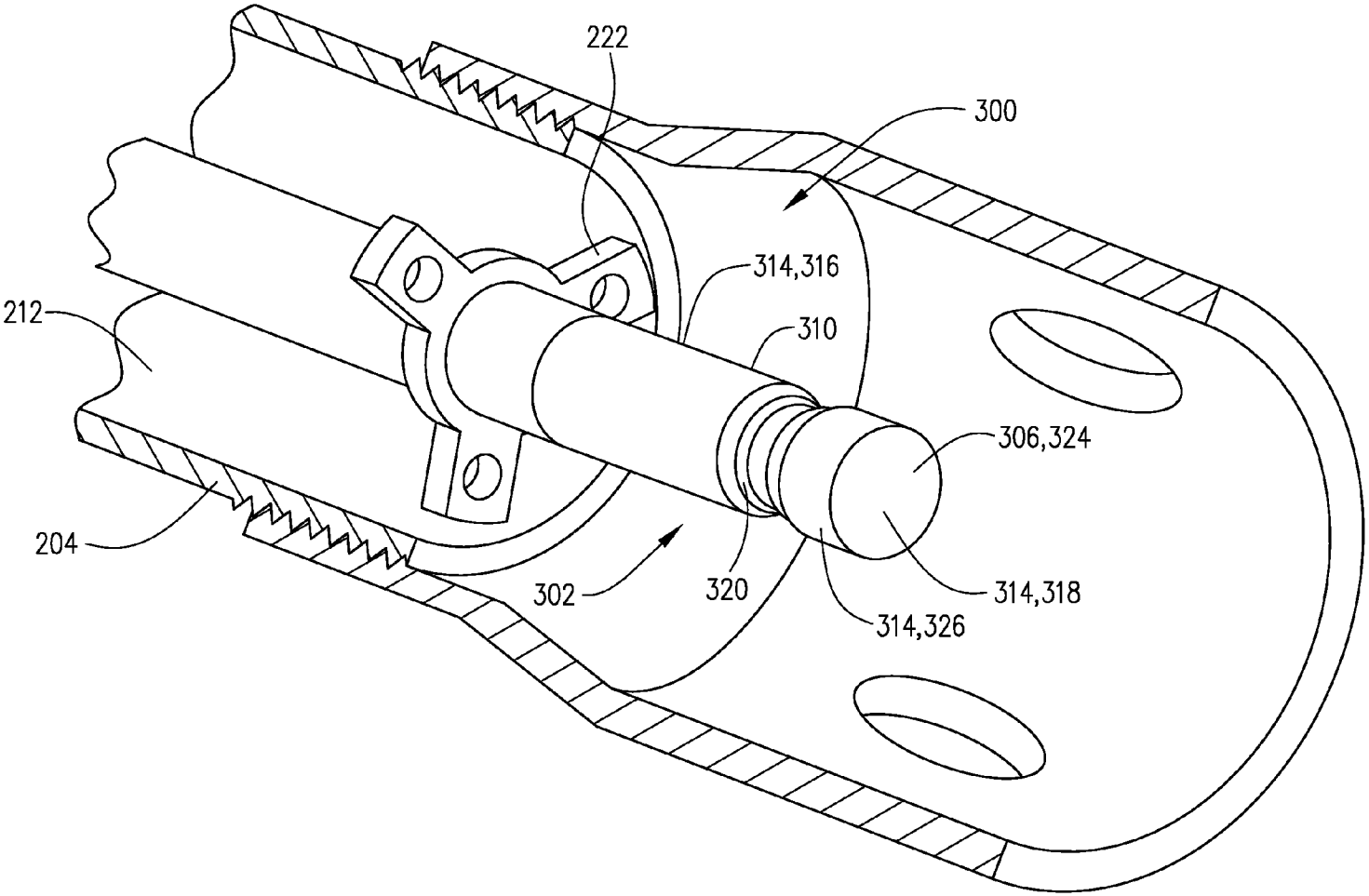
FIG. 3 is a perspective view with partial cutaway of a spark igniter in accordance with an embodiment of the current invention.
Figure 4:
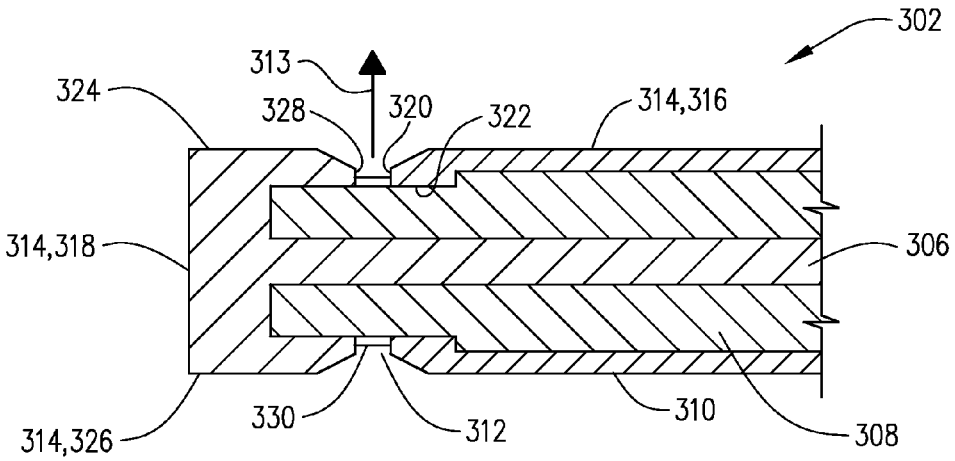
FIG. 4 is a sectional view of an igniter tip in accordance with the embodiment illustrated in FIG. 3.

Turning now to FIGS. 2-4 a burner pilot 200 in accordance with one embodiment of the current invention is illustrated. Burner pilot 200 has a housing 202. Housing 202 is comprised of a main pipe or tube portion 204, electronics enclosure 216 and fuel introduction pipe 218. Tube portion 204 has a wall 206 having a first end 208 and a second end 210 and a longitudinal fuel flow passage or fuel channel 212 defined by wall 206. Second end 210 is connected to electronics enclosure 216 and the wall 206 defines an opening 214 at first end 208. At or near second end 210 will be a sealing device 220 which seals fuel channel 212 so that it is not in fluid flow communication with electronics enclosure 216 and, hence, so that fuel cannot enter electronics enclosure 216.

Fuel introduction pipe 218 is in fluid flow communication with a fuel source (not shown) and longitudinal fuel flow passage 212 of tube portion 204. Generally, a fuel-air mixture will be introduced into passage 212 through pipe 218 such that the fuel-air mixture will flow in a generally longitudinal direction towards first end 208 and out opening 214.

Extending longitudinally inside and along longitudinal passage 212 is a spark igniter 300. Generally, spark igniter 300 is held in place by sealing device 220 and structural supports 222. Structural supports 222 can be perforated to limit obstruction of the flow of the fuel and air mixture and can be shaped into swirling or diffusion elements to induce premixing of fuel and air within longitudinal passage 212 and prior to reaching the first end 302 of spark igniter 300.

Spark igniter 300 has a first end or igniter tip 302 located inside tube portion 204 but near the first end 208 of tube portion 204 and a second end 304 extending into electronics enclosure 216. As can best be seen from FIGS. 3 and 4, spark igniter 300 is comprised of a center electrode 306, an insulating sleeve or tube 308 and an outer electrode shell or electrode tube 310. Center electrode 306, insulating sleeve 308 and electrode shell 310 generally extend from the igniter tip 302 to the second end 304 of spark igniter 300 with center electrode 306 extending though the center of electrode shell 310 and insulating sleeve 308 being positioned between center electrode 306 and electrode shell 310 in order to prevent electrical conductivity between the two electrodes.

As illustrated, spark igniter 300 is a high-energy igniter (HEI) probe. Accordingly, spark igniter 300 should be suitable to pass large current pulses (often greater than 1 kA) from an energy source to the spark gap and, thereby, generate a spark at the spark gap. The purpose of an HEI probe is to provide high ignition power. In applications with low temperatures, heavy fuels (heavy gases or oils), contamination of the igniter plug with coking or other debris, or moisture presence due to steam purging or rain, the main fuel may be difficult to light but an HEI system has the ability to maintain powerful high energy sparks in these adverse conditions.

An HEI system generally has a spark igniter and capacitive discharge system to provide a high-energy pulse to the spark igniter. As illustrated in FIG. 2, electronics enclosure 216 has located therein an exciter 224. Exciter 224 is connected to a power supply (not shown but generally located outside of electronics enclosure 216), which provides electrical power to exciter 224. Exciter 224 can be any high-energy exciter known in the art and suitable to provide a rapid electrical pulse to spark igniter 300 and, thus, cause a spark at spark gap of the spark igniter, as discussed below. For example, exciter 224 can be a capacitive discharge device.

Spark igniter 300 is connected at its second end 304 to exciter 224 so that center electrode 306 is connected to a first terminal of exciter 224, generally the high voltage terminal, and electrode shell 310 is connected to a second terminal of exciter 224, generally the low voltage terminal, which can be electrically grounded.

Turning now on FIGS. 3 and 4, spark igniter 300 and igniter tip 302 will be further described. As described above, the spark igniter 300 is constructed using a center electrode 306, an insulation system (typically comprising insulation sleeve or tube 308) and electrode shell 310. Electrode shell 310 can be about 0.25 to 0.75 inches in diameter. It should be understood that while spark igniter 300 is illustrated as having a center electrode covered by a concentric insulating sleeve and a concentric electrode tube, it could have any other suitable design consistent with the spark tip 302 as hereinafter described. Generally, spark igniter 300 will have a first electrode and a second electrode that are electrically isolated from each other but with ends that are adapted to produce a radially-directed spark upon application of an electrical charge on the opposite ends of the electrodes. Thus, for example, the first and second electrodes could form two halves of a cylindrical spark igniter rod with an insulator sandwiched between them, as long as they culminated in a spark tip suitable for producing a radially directed spark such as, but not limited to, the embodiments described below.

The igniter tip 302 comprises an outer surface 314 comprised of a side surface 316 and end surface 318. The side surface 316 typically extends between the end surface 318 of the igniter tip 302 and the second end 304 of the spark igniter 300. The igniter tip 302 terminates in end surface 318, which is an axially-facing surface, as can be seen from the figures. Generally, the igniter tip in accordance with the invention is configured so that a spark gap 312 is on a radially-facing surface such as side surface 316 of spark igniter 300. In FIGS. 3 and 4 an embodiment is illustrated where electrode shell 310 forms a portion of the side surface extending from second end 304 of the spark igniter 300 and terminating at edge 320, which defines an open end 322 of the electrode shell. Electrode 306 extends from second end 304, though the inside of the electrode shell 310 and out the open end 322 of the electrode shell. The portion of electrode 306 extending out the open end 322 forms a cap 324 forming the end surface 318 and the cap side surface 326, which is the portion of the side surface 316 adjacent to the end surface 318. The spark gap 312 is located between the side surface 326 of the cap 324 and the open end 322 of the electrode shell 310 or, more specifically, between edge 328 of the cap and edge 320 of the electrode shell 310.

As shown, insulator 308 extends concentrically around electrode 306 within electrode shell 310 so that the two electrodes do not make electrical contact. Further, spark gap 312 is between the electrode 306 and the electrode shell 310 and extends down to insulator 308 so that electrode 306 and electrode shell 310 do not make electrical contact. Additionally, there can be a semiconductor material 330 deposited on the insulator at the bottom of the spark gap 312. Semiconductor material 330 forms a conductive path between the electrode 306 and the electrode shell 310. This semiconductor can be a film applied to the insulator itself. This semiconductor assists the spark igniter 300 with spark initiation by allowing a low level of current to pass in the semiconductor when the energy source applies an ignition pulse to the electrode 306. This low level current flowing through the semiconductor creates a small ionized air zone above the path of current in the spark gap 312. This small ionized air path is a low impedance pathway for current flow. Once the pathway is established, the electrical energy is able to flow unresisted except for circuit impedance, thereby creating a very high current and energy spark at spark gap 312.

As illustrated in FIGS. 3 and 4, the electrode 306, insulator 308 and electrode shell 310 are cylindrical and spark gap 312 extends circumferentially completely around the cylindrical side surface 316. It should be understood that other shapes are within the scope of the invention as is a spark gap that extends only partially around the circumference by either extending the insulator into the spark gap or limiting the semiconductor material to a portion of the spark gap. For example, side surface 316 can have a square or rectangular cross section with the spark gap extending only across one, two or three of the sides of the square or rectangle.

Figure 7:
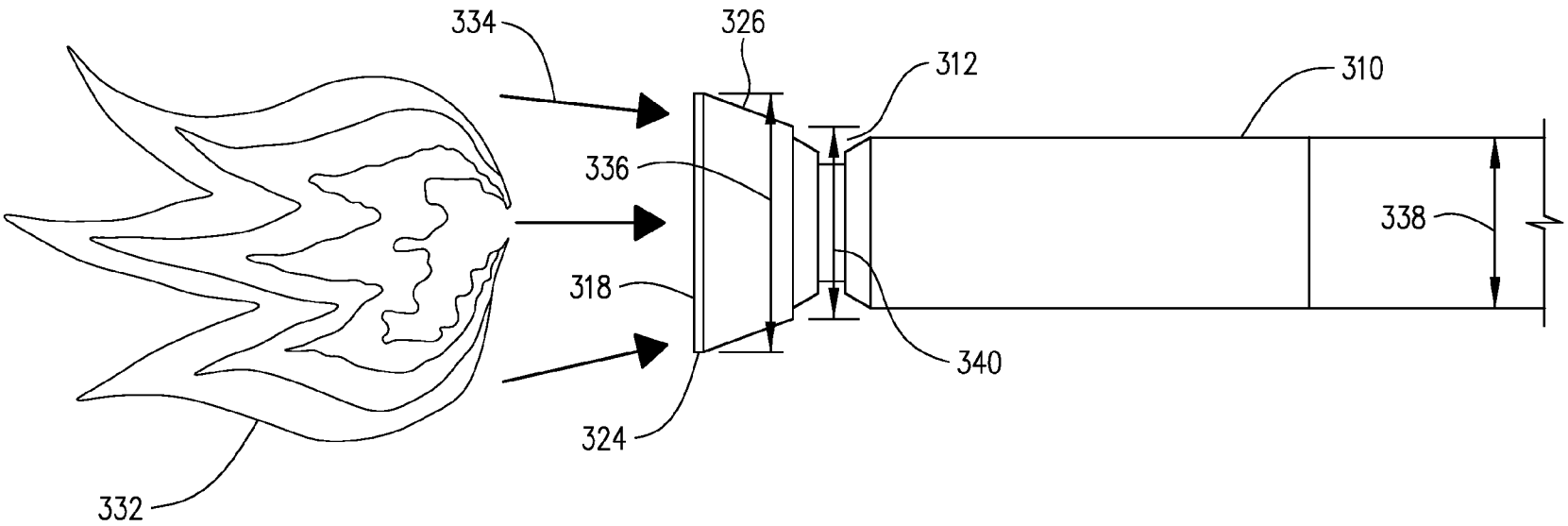
FIG. 7 is an elevation view of an igniter tip in accordance with still another embodiment of the current invention and illustrating flame radiation shielding.

The spark generated at spark gap 312 is projected perpendicular to the longitudinal axis of spark igniter 300 and outward into the fuel-air mixture flowing through tube portion 204 and will, thus, be projected perpendicular to the flow of the fuel-air mixture, as shown by arrow 313. In the embodiment illustrated, the spark igniter is cylindrical and thus the spark is projected radially outward; however, a similar spark projection, perpendicular to the longitudinal axis, will apply to other configurations, such as a spark igniter having a square, rectangular, triangular or oblong cross-section, and will generally be herein referred to as a "radially-directed spark." The spark will ignite the fuel-air mixture forming a flame that will be located downstream from end surface 318; that is, the flame will be located on the other side of end surface 318 from spark gap 312. Accordingly, cap 324 will act to shield the spark gap 312 and semiconductor material 330 from flame radiation generated from the flame. Turning now to FIG. 7, flame 332 is illustrated downstream from end surface 318. As can be seen, flame radiation, indicated by arrows 334, is blocked by end surface 318. In this embodiment, the outer diameter 336 of end surface 318 (also called herein "end diameter") is larger than the outer diameter 338 of the electrode shell 310. Thus, the shielding effect is increased by the larger end diameter 336. As illustrated, the end cap can have a partial conical side surface 326 so that its diameter is reduced towards the cap gap edge 328 to having an edge diameter 340, which is smaller than end diameter 336 but can be equal to or larger than outer diameter 338 of the electrode shell 310.

Figure 5:
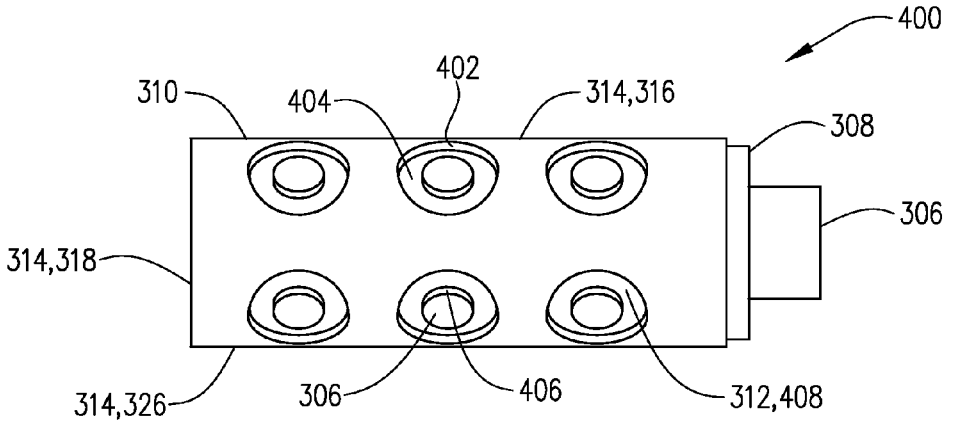
FIG. 5 is an elevation view of an igniter tip in accordance with another embodiment of the current invention.
Figure 6:
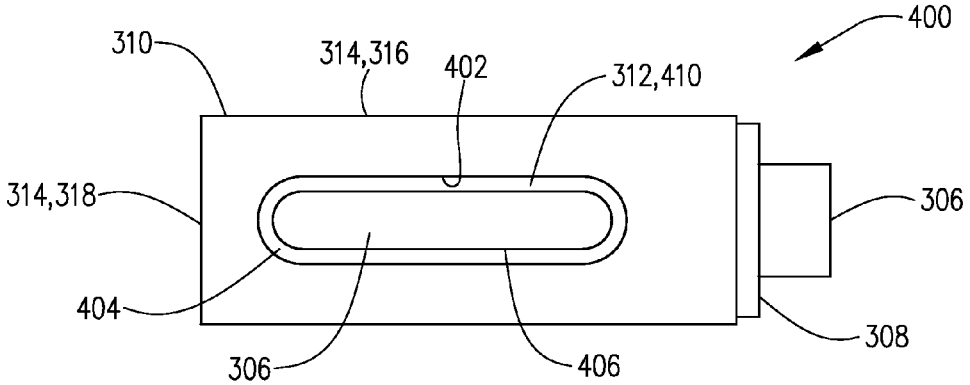
FIG. 6 is an elevation view of an igniter tip in accordance with yet another embodiment of the current invention.

Turning now to FIGS. 5 and 6, alternative embodiments of a spark tip 400 in accordance with the invention can be seen. In FIGS. 5 and 6, as well as the other embodiments described below, like parts have been given like reference numerals. FIGS. 5 and 6 illustrate an electrode shell 310 forming a portion of the outer surface 314, including end surface 318 and a first portion of side surface 316. Electrode shell 310 has a first gap edge 402 defining an aperture 404 in the side surface 316. Generally, electrode shell 310 can form all of the outer surface 314, except for within aperture 404. The electrode 306 extends concentrically through electrode shell 310 with insulating sleeve 308 being concentric with and between electrode shell 310 and electrode 306 so that the two electrodes do not make electrical contact. Electrode 306 forms a second portion of the side surface 316 by extending up through insulating sleeve 308 within aperture 404; thus, electrode 306 forms a second gap edge 406 within aperture 404 such that first gap edge 402 and second gap edge 406 define the spark gap 312. Generally, the first gap edge 402 and the second gap edge 406 can have the same shape and can be concentric. As illustrated in FIG. 5, the first gap edge 402 and the second gap edge 406 are circular and are concentric so as to form a circular spark gap 408. As illustrated in FIG. 6, the first gap edge 402 and the second gap edge 406 are oblong so as to form oblong spark gap 410. In the embodiments illustrated in FIGS. 5 and 6, there can be a single spark gap or a plurality of spark gaps on the side surface and these spark gaps can be distributed about the circumference of the side surface or can be confined to a portion of the side surface. For example, in FIG. 5, multiple circular spark gaps 408 are distributed evenly about the circumference of the side surface 316. In FIG. 6, a single oblong spark gap 410 is confined to one-half of the circumference of the side surface 316 or less.

Figure 8A:
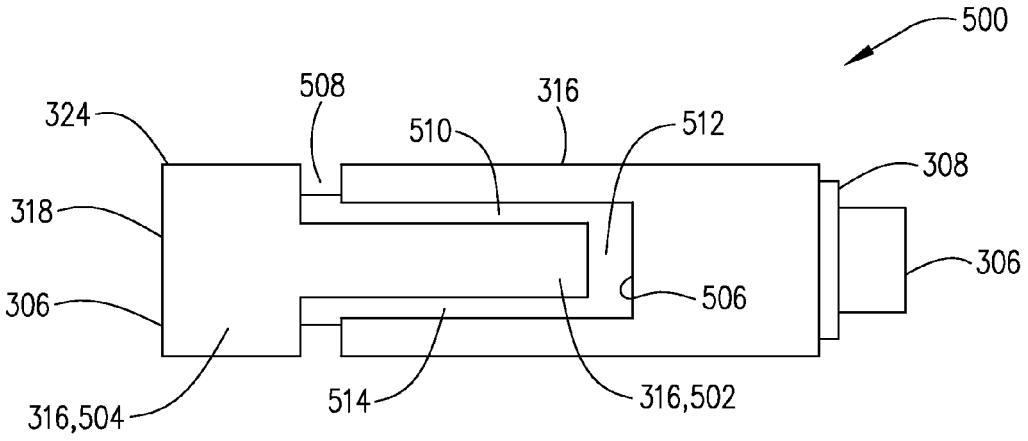
FIGS. 8 A-C are elevation views from different angles of an igniter tip in accordance with still another embodiment of the current invention.
Figure 8B:
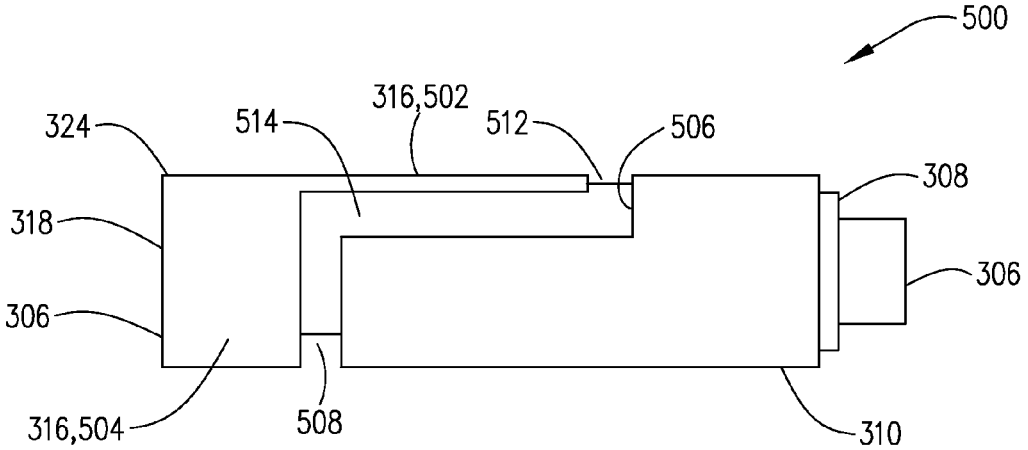
Figure 8C:
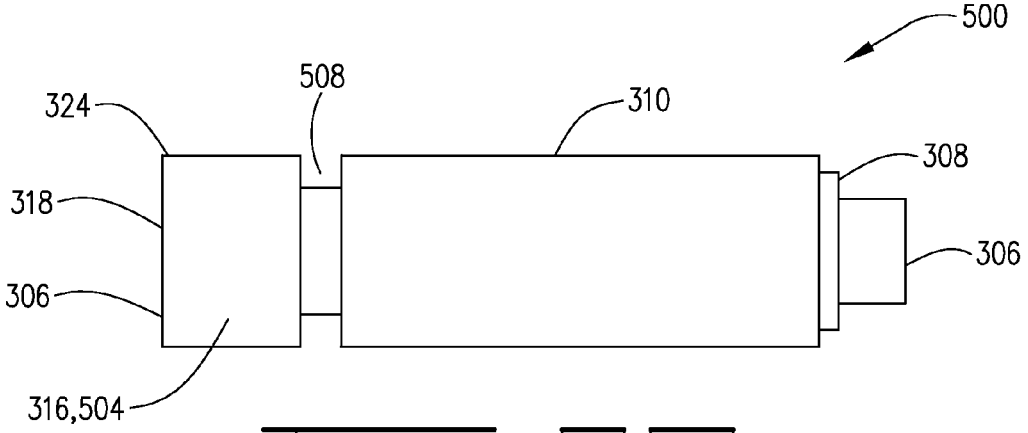

Turning now to FIGS. 8A, 8B and 8C, a further embodiment of a spark tip 500 can be seen. The embodiment of FIGS. 8A-8C is similar to the embodiment of FIGS. 3 and 4 with the electrode 306 forming cap 324, except that cap 324 has a tab 502 extending therefrom. Thus, cap 324 includes a first side surface portion 504 and tab 502. First side surface portion 504 is a portion of the side surface 316 adjacent to end surface 318 and extending longitudinally towards second end 303 (see FIG. 2) of spark igniter 300 by a first length. Tab 502 is a second portion of the side surface adjacent to the end surface 318 and extending longitudinally towards second end 303 of spark igniter 300 by a second length. The first length of first side surface portion 504 is less than the second length of tab 502. As can be seen from the figures, this means tab 502 has an edge having two longitudinal portions and a circumferential portion. Likewise, electrode shell 310 has a notch 506 having an edge having two longitudinal portions and a circumferential portion. Thus the spark gap is a longitudinal and circumferentially extending gap having a first circumferential portion 508, a first longitudinal portion 510, a second circumferential portion 512 and a second longitudinal portion 514.

In the above embodiments, the semiconductor may be deposited on only a portion of the surface of the insulator in the spark gap to effectively reduce the spark direction. For example, in the embodiment illustrated in FIGS. 8A-C, first circumferential portion 508 of the spark gap cannot have semiconductor material on the insulator surface while the first longitudinal portion 510, second circumferential portion 512 and second longitudinal portion 514 can have semiconductor material on the insulator surface; thus, resulting in a spark production restricted to the gap around the tab.

In order to further illustrate the spark igniter of this invention, its operation and the methods of the invention, the following example is given.

EXAMPLE

Three igniter tips were life tested by repeatedly firing each igniter tip until it no longer fired. Control 1 and Control 2 were axially-directed spark tips and Example 1 was a radially-directed spark tip in accordance with the embodiment of the invention illustrated in FIGS. 3 and 4. The electrode material (center and shell) for each igniter tip were made from an austentic nickel-chromium-based superalloy sold under the trademark INCONEL 600 by the Special Materials Corporation group of companies. The igniter tips were connected to a 4 joules stored energy exciter producing a spark rate of 15 sparks per second and with a duty cycle of 30 seconds on, 30 seconds off. Further information on the igniter tips and the results of the life test are given in Table I.

TABLE I

| | Control 1 | Control 2 | Example 1 |
|---|---|---|---|
| Outer Diameter (inches) | 0.5 | 0.625 | 0.5 |
| Air Gap or Spark Gap (mm) | 1 | 1.5 | 1 |
| Total Number of Sparks Until Failure | 2,193,434 | 2,674,194 | 4,790,000 |

As can be seen from Table I, the inventive radially-directed spark tip (Example 1) had a significantly longer spark life than either of the traditional axially-directed spark tips (Control 1 and Control 2). Example 1 had a 218% longer spark life than Control 1 and a 179% longer spark life than Control 2.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A spark igniter comprising a plurality of electrodes and an insulator, which are configured to form an elongated body having a first end, a second end and an outer surface extending between the first end and the second end;

wherein the outer surface comprises a side surface and an end surface, wherein the end surface is located at the first end, and the side surface extends between the first end and the second end, wherein the spark igniter is configured to form a spark gap on the side surface, which produces a radially-directed spark, wherein the plurality of electrodes comprises a first electrode and a second electrode and at least a portion of the second electrode forms an electrode shell, which surrounds at least a portion of the first electrode and forms at least part of the side surface;

wherein the insulator is between the first electrode and the electrode shell, wherein a portion of the side surface is adjacent to the end surface and the electrode shell defines an open end and the first electrode extends through the inside of the electrode shell and out the open end to form a cap forming the end surface and the portion of the side surface adjacent to the end surface, and wherein the spark gap is between the side surface of the cap and the open end of the electrode shell.

2. The spark igniter of claim 1 wherein the side surface is a cylindrical surface and the spark gap is a circumferentially extending gap.

3. The spark igniter of claim 2 wherein the circumferentially extending gap extends completely around the cylindrical surface.

4. The spark igniter of claim 1 wherein the first electrode forms a first edge of the circumferentially extending gap and the open end of the electrode shell forms a second edge of the circumferentially extending gap.

5. The spark igniter of claim 1 wherein the end surface offers at least partial protection for the spark gap from flame radiation.

6. The spark igniter of claim 5 wherein the end surface has an end diameter and the electrode shell has an outer diameter and the end diameter is greater than the outer diameter.

7. The spark igniter of claim 1 wherein the side surface of the cap includes a first side surface portion extending longitudinally toward the second end and having a first length and a tab portion extending longitudinally toward the second end and having a second length, wherein the first length is less than the second length and the spark gap extends around the tab portion.

8. The spark igniter of claim 7 wherein the tab portion has two longitudinal edges and a circumferential edge and the electrode shell is a cylindrical surface having a notch with the open end forming an edge spaced from and opposing the tab so that the spark gap is a circumferentially and longitudinally extending gap.

9. A spark igniter comprising a plurality of electrodes and an insulator, which are configured to form an elongated body having a first end, a second end and an outer surface extending between the first end and the second end;

wherein the outer surface comprises a side surface and an end surface, wherein the end surface is located at the first end, and the side surface extends between the first end and the second end, wherein the spark igniter is configured to form a spark gap on the side surface, which produces a radially-directed spark, wherein the plurality of electrodes comprises a first electrode and a second electrode and at least a portion of the second electrode forms an electrode shell, which surrounds at least a portion of the first electrode and forms at least part of the side surface;

wherein the insulator is between the first electrode and the electrode shell, wherein the electrode shell forms the end surface, wherein the electrode shell has a first gap edge defining an aperture in the side surface, and wherein the first electrode forms at least part of the side surface and forms a second gap edge within the aperture such that the first gap edge and second gap edge define the spark gap.

10. The spark igniter of claim 9 wherein the first gap edge and the second gap edge are the same shape and are concentric.

11. The spark igniter of claim 10 wherein the first gap edge and the second gap edge are an elongated closed curve and are confined to one-half of the circumference of the side surface.

12. The spark igniter of claim 10 wherein the first gap edge and the second gap edge are circular and are concentric and where there is a plurality of spark gaps formed on the side surface.

* * * * *